US008070550B2

(12) United States Patent
Song et al.

(10) Patent No.: US 8,070,550 B2
(45) Date of Patent: Dec. 6, 2011

(54) BLOCK FOR BUILDING A TOY

(75) Inventors: Kyoung Woon Song, Seongnam-si (KR); Jong Sung Kim, Incheon (KR)

(73) Assignee: Edtoy Co., Ltd., Bupyeong-Gu, Incheon (KR)

( * ) Notice: Subject to any disclaimer, the term of this patent is extended or adjusted under 35 U.S.C. 154(b) by 279 days.

(21) Appl. No.: 12/408,132

(22) Filed: Mar. 20, 2009

(65) Prior Publication Data

US 2009/0181595 A1 Jul. 16, 2009

Related U.S. Application Data

(63) Continuation-in-part of application No. 12/402,742, filed on Mar. 12, 2009, now Pat. No. 7,985,116, which is a continuation-in-part of application No. 12/440,933, filed as application No. PCT/KR2007/004248 on Sep. 4, 2007.

(30) Foreign Application Priority Data

Sep. 13, 2006 (KR) ..... 10-2006-0088369

(51) Int. Cl.
*A63H 33/00* (2006.01)
*A63H 33/04* (2006.01)

(52) U.S. Cl. ..... 446/92; 446/129

(58) Field of Classification Search ..... 446/71, 446/72, 92, 129–139, 168, 85; 273/156, 273/157 R, 456, 155
See application file for complete search history.

(56) References Cited

U.S. PATENT DOCUMENTS

| | | | | |
|---|---|---|---|---|
| 2,665,913 | A | 1/1954 | Hlavac | |
| 2,970,388 | A | 2/1961 | Yonkers | 35/18 |
| 5,152,711 | A | 10/1992 | Gross | 446/139 |
| 6,048,248 | A | 4/2000 | Ritchey | |
| 6,749,480 | B1 * | 6/2004 | Hunts | 446/92 |
| 6,846,216 | B1 | 1/2005 | Balanchi | 446/85 |
| 6,969,294 | B2 | 11/2005 | Vicentelli | 446/92 |
| 7,413,493 | B2 * | 8/2008 | Toht et al. | 446/92 |
| 2004/0116038 | A1 | 6/2004 | Hunts | 446/92 |
| 2006/0111010 | A1 | 5/2006 | Park | |
| 2006/0240737 | A1 | 10/2006 | Yoon | 446/92 |
| 2007/0287353 | A1 | 12/2007 | Vicentelli | 446/92 |

FOREIGN PATENT DOCUMENTS

| | | |
|---|---|---|
| JP | 09-140855 | 6/1997 |
| KR | 10-2004-0065186 | 7/2004 |
| KR | 10-0841960 | 6/2008 |
| WO | WO 2006/112679 A1 | 10/2006 |

OTHER PUBLICATIONS

Office Action dated Oct. 21, 2010 issued in U.S. Appl. No. 12/440,933.
International Search Report dated Dec. 21, 2007.
European Search Report dated Jul. 28, 2010 issued in Application No. 10002520.4-2318.
U.S. Office Action issued in U.S. Appl. No. 12/647,241 dated Jul. 14, 2011.
International Search Report dated Dec. 21, 2007.

* cited by examiner

*Primary Examiner* — Nini Legesse
(74) *Attorney, Agent, or Firm* — KED & Associates LLP

(57) ABSTRACT

A block for building a toy is provided. The block includes a body, a case provided in the body, a holder with a sliding-prevention part, provided movably and rotatably within the case, and a magnet with south and north pole faces, installed in the holder. The blocks, each with this construction, can connect to each other to build a toy, without sliding off relative to each other.

16 Claims, 9 Drawing Sheets

BLOCK FOR BUILDING A TOY

This application is a Continuation-In-Part of U.S. patent application Ser. No. 12/402,742 filed Mar. 12, 2009 now U.S. Pat. No. 7,985,116, which is a Continuation-In-Part of U.S. patent application Ser. No. 12/440,933 filed Mar. 12, 2009, which is the National Stage Application of PCT/KR2007/004248 filed Sep. 4, 2007, which claims priority to Korean Patent Application No. 10-2006-0088369, filed on Sep. 13, 2006, whose entire disclosures above are incorporated by reference herein.

BACKGROUND

1. Field

This disclosure relates to a block for building a toy.

2. Description of the Background Art

Generally, a block for building a toy has male and female connection parts. The male connection part of the one block is inserted into the female connection part of the other block to build a toy. The LEGO group's product is typical of the block of this kind.

There is another kind of block for building a toy, which is equipped with rotatable magnets, each having south and north pole faces. The south pole face of the magnet installed in the one block connects to the north pole face of the magnet installed in the other block or vice versa.

The blocks, each with rotatable magnets, connect to each other, as they are, to build a toy, by enabling the outside faces of magnets in the blocks, which are to come in contact with each other, to have unlike poles. When the outside faces of magnets in the blocks happen to have like poles, any of the magnets rotates itself to have unlike pole.

To do this, the magnet is installed in a case with two opposite spindles protruding from its lateral side, and a body of the block has two opposite holes in the inside wall, into which the two opposite spindles, respectively. The case is rotatable with the two opposite spindles being inserted into the corresponding two holes, respectively. However, particles are trapped between the spindles and the inside walls of the holes, thereby preventing the case from smoothly rotating.

The block has alternate protrusions and indentations on the contact surface. When the blocks connect to each other by magnetic force to build a toy, the protrusions on the contact surface of the one block fit into the indentations on the contact surface of the other block. This prevents the blocks from sliding off with respect to each other. However, the protrusions and indentations are subject to damage. The human body may get hurt with the protrusions. It is difficult to form the alternate protrusions and indentations on the contact surface of the block made of wood.

BRIEF DESCRIPTION

Therefore, an object of the present disclosure is to provide a block for building a toy, capable of connecting to the other block of the same construction, without sliding off with respect to each other, by enabling outside faces of the magnets on the blocks to have unlike poles.

Another object of the present disclosure is to provide a block for building a toy, with a sliding-prevention part being positioned inside a body of the block, capable of connecting to the other block of the same construction, without sliding off with respect to each other, by enabling outside faces of the magnets of the blocks to have unlike poles.

According to an aspect of the present disclosure, there is provided a block for building a toy, including a body, a case installed in the body, a holder with a sliding-prevention part, movable and rotatably provided within the case, and a magnet with south and north pole faces, installed in the holder.

Free rotation of the holder within the case enables outside faces of the magnets in the blocks to have unlike poles. This makes it possible to connect the blocks, as they are, without having to change their current positions.

The holder rotates with two opposite spindles protruding from its outside circumferential surface being located within corresponding two longitudinal pockets. That is, the two spindles function as an axis about which the holder rotates. The longitudinal pockets are so wide that the spindles can freely move and rotate within it although particles are trapped between the spindles and the inside walls of the longitudinal pockets. Accordingly, the holder rotates without a hitch.

The sliding-prevention part is provided on the holder instead of on the body. This locates the sliding-prevention part inside the body, thereby eliminating the need for providing the sliding-prevention part on the body. That is, the sliding-prevention part is hidden inside the body. As a result, a limitation to use of a material of the body is overcome. Furthermore, the sliding-prevention part is prevented from causing possible damage to itself and the human body.

The foregoing and other objects, features, aspects and advantages of the present disclosure will become more apparent from the following detailed description of the present disclosure when taken in conjunction with the accompanying drawings.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure.

In the drawings.

DETAILED DESCRIPTION

Reference will now be made in detail to the preferred embodiment of the present disclosure, an example of which is illustrated in the accompanying drawings.

Figure 1:
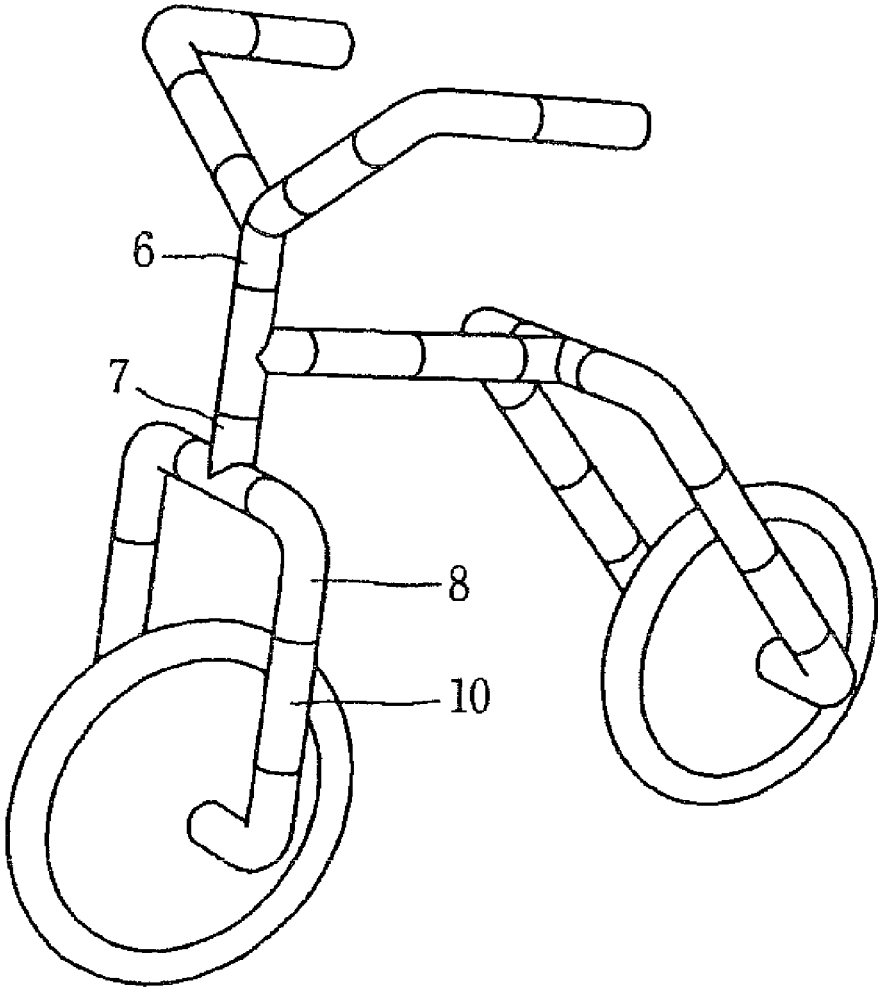
FIG. 1 is a view of a bicycle-shaped toy which is built with blocks for building a toy, according to the embodiment of the present disclosure.

Referring to FIG. 1, an embodiment of the present disclosure is now described.

FIG. 1 is a view of a bicycle-shaped toy which is built with blocks for building a toy, according to the embodiment of the present disclosure. FIGS. 2A, 2B, 2C, and 2D are views of some blocks which are used in building the bicycle-shaped toy of FIG. 1.

As shown in FIG. 1, for example, the bicycle-shaped toy is built by connecting a contact surface 21 of the one block to a contact surface 21 of the other block by a virtue of a magnetic force which is generated between the unlike pole faces of the two magnets 50 of the two blocks. The blocks 6, 7, 8, and 10 are typical ones used in building the bicycle-shaped toy. A variety of toys can be built with the blocks according to the present disclosure.

The blocks 6, 7, 8, and 10 are the same in construction, but different in body shape. Therefore, descriptions of the blocks 6, 7, and 8 are omitted and only the block 10 of FIG. 2D is now described.

Figure 2A:
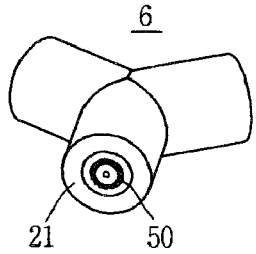
FIGS. 2A, 2B, 2C, and 2D are views of some blocks which are used in building the bicycle-shaped toy of FIG. 1.
Figure 2B:
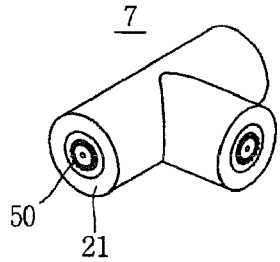
Figure 2C:
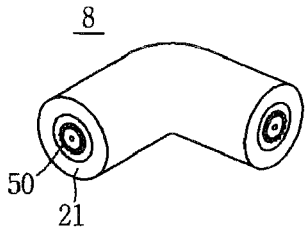
Figure 2D:
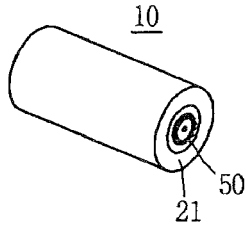
Figure 3:
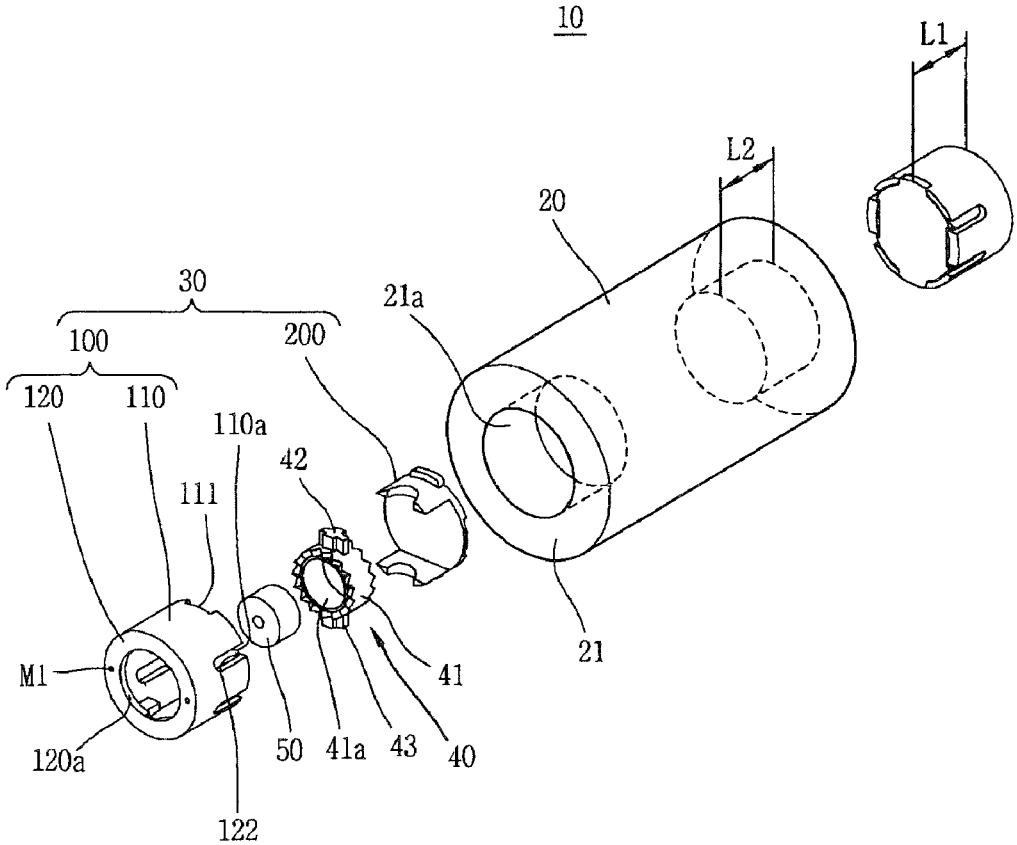
FIG. 3 is a perspective view of the disassembled block of FIG. 2D.

FIG. 3 is a perspective view of the disassembled block of FIG. 2D

As shown in FIG. 3, the block 10 according to the embodiment of the present disclosure includes a body 20, a case 30, a holder 40, and a magnet 50.

The body 20 is cylinder-shaped. The body 20 is made of wood. The body 20 has a hole 21A in the contact surface 21 thereof.

The case 30 fits into the hole 21A in the contact surface 21. So, the case 30 is held firmly in place in the hole 21A. If not, the case 30 may be held firmly in place in the hole 21A with an adhesive agent. The length L1 of the case 30 is the same as the depth L2 of the hole 21A. This is done to prevent the case 30 from protruding from the hole 21A. As a result, when the blocks connect to each other, the contact surfaces of the blocks come in contact with each other.

A hole may be pierced lengthwise through the body 20 from the bottom of the hole 21A. A hole may be pierced through the magnet 50 and the case 30. Formation of the holes in the body 20, the case 30, and the magnet 50 provides a passage through which a glass bead rolls or a liquid flows. The body 20 may be made of a transparent material, so the glass bead or the liquid is seen to roll or flow through the passage.

Figure 4:
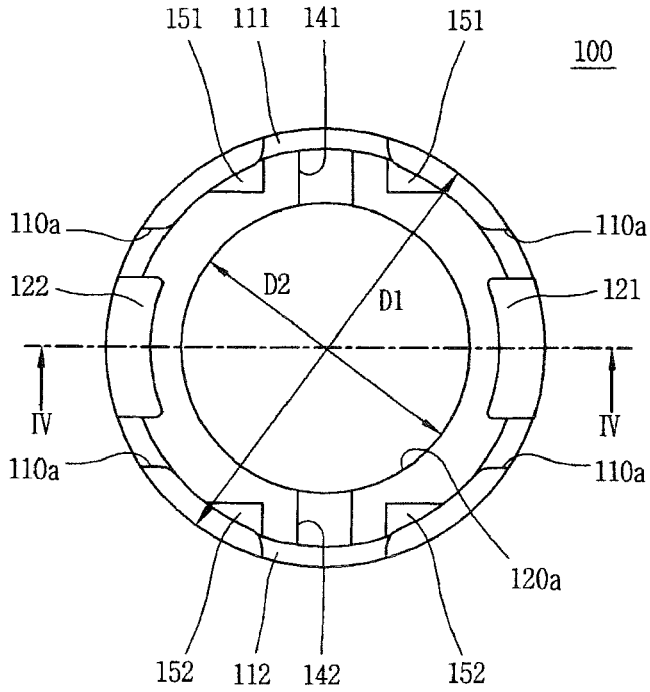
FIG. 4 is a rear view of a first case of FIG. 3.
Figure 5:
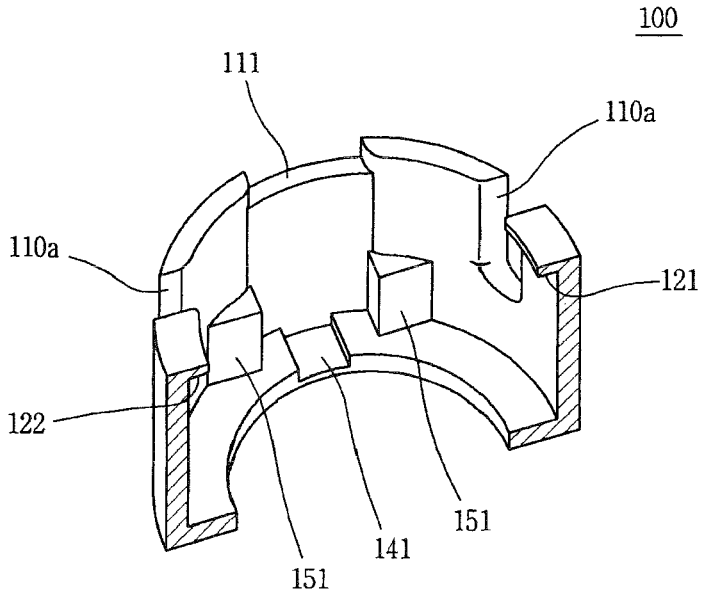
FIG. 5 is a vertical cross-sectional view of the first case of FIG. 4, cut along a line IV-IV.
Figure 6:
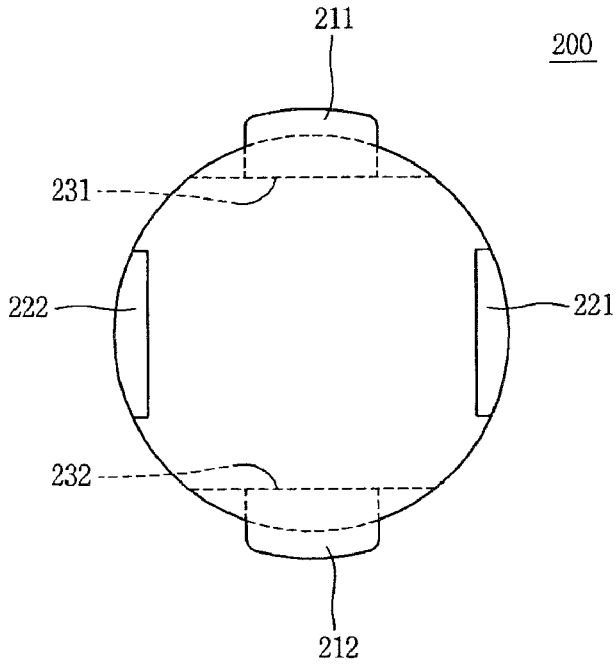
FIG. 6 is a top view of a second case of FIG. 3.
Figure 7:
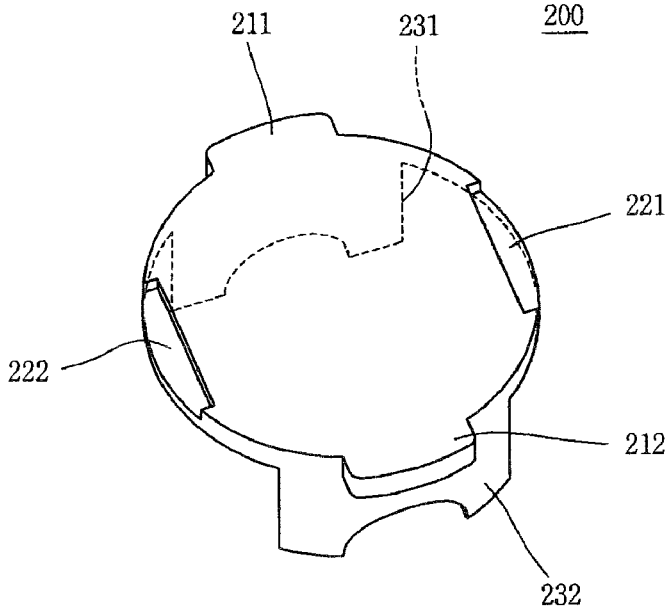
FIG. 7 is a perspective view of the second case of FIG. 3.

FIG. 4 is a rear view of a first case of FIG. 3. FIG. 5 is a vertical cross-sectional view of the first case of FIG. 4, cut along a line IV-IV. FIG. 6 is a top view of a second case of FIG. 3. FIG. 7 is a perspective view of the second case of FIG. 3.

As shown in FIG. 3, the case 30 includes the first case 100 and the second case 200.

As shown in FIGS. 3 through 5, the first case 100 includes a case body 110 and a case cover 120 covering the front of the case body 110. The case body 110 is cylinder-shaped. The case body 110 has first and second protrusions 121 and 122, opposite to each other, on the end. The first and second protrusions 121 and 122 horizontally protrude inward from the lateral side of the case body 110.

Two slots 110A are made in the lateral side of the case body 110 with the first protrusion 121 in between, to make the first protrusion 121 movable back and forth. The two slots 110A are made in the lateral side of the case body 110 with the second protrusion 122 in between, to make the second protrusion 122 movable back and forth. The case body 110 has first and second openings 111 and 112, opposite to each other, on the end. The first and second openings 111 and 112 are spaced a given distance from the first and second protrusions 121 and 122.

The case cover 120 is circular. The case cover 120 has a hole 120A in the middle. The diameter D2 of the hole 120A is smaller than the diameter D1 of the case body 110. The holder body 41 of the holder 40 is inserted into the hole 120A. Reference points M1 are marked on the front of the case cover 120, but on the line passing the center point of the hole 120A. The reference points M1 are later described.

Figure 9:
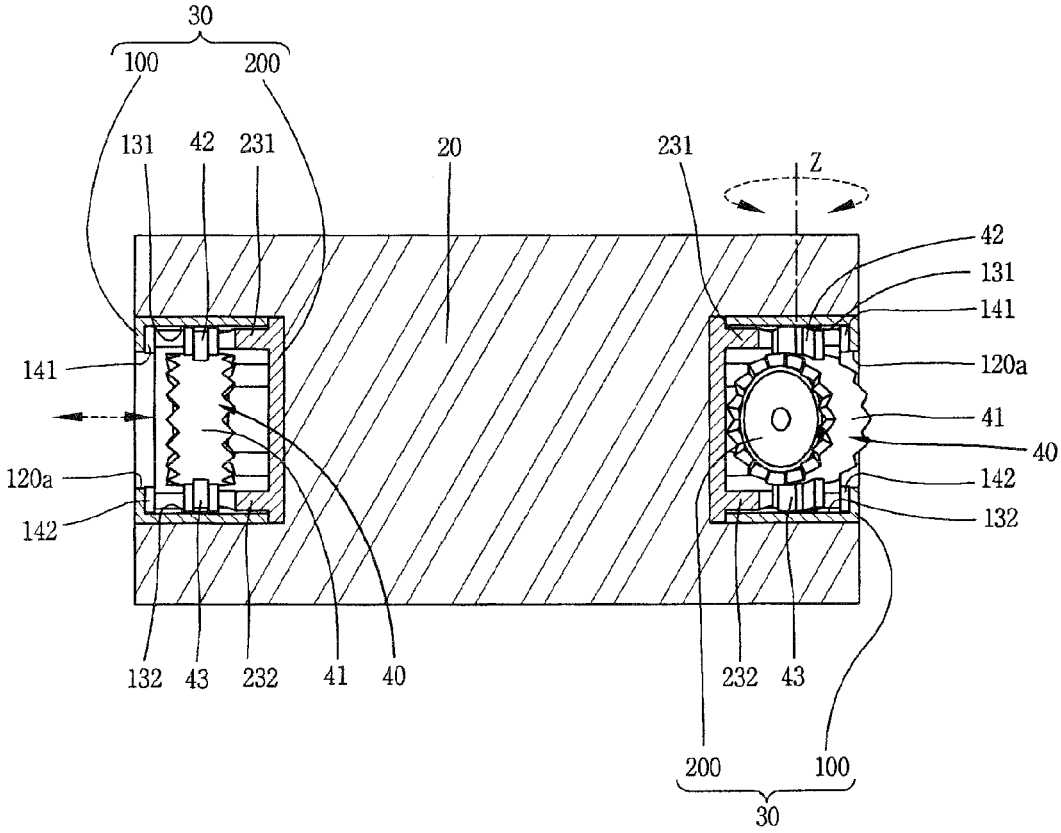
FIG. 9 is a view illustrating that the holder of FIG. 3 moves and rotates within the case.

The case cover 120 has first and second spindle pockets 141 and 142, opposite to each other, on the rear. The first and second spindles 42 and 43 are inserted into the first and second spindle pockets 141 and 142, respectively. The case 30 has first and second front protrusions 151 and 152 which protrude from the rear of the case cover 120 and the lateral side of the case body 110. The two first front protrusions 151 are behind the first spindle pocket 141 and are opposite to each other with the first spindle pocket 141 in between. The two first front protrusions 151 form the front section of a first longitudinal pocket 131 as shown in FIG. 9. The two second front protrusions 152 are behind the second spindle pocket 142 and are opposite to each other with the second spindle pocket 142 in between. The two second front protrusions 152 form the front section of a second longitudinal pocket 132 as shown in FIG. 9.

As shown in FIGS. 3, 5, 6 and 7, the second case 200 has first and second indentations 221 and 222, opposite to each other, on the front. The first and second protrusions 121 and 122 are inserted into the first and second indentations 221 and 222, respectively.

The second case 200 has first and second connection protrusions 211 and 212, opposite to each other, on the lateral side. The first and second connection protrusion 211 and 212 horizontally protrude outward from the lateral side of the second case 200. The first and second connection protrusion 211 and 212 are inserted into the first and second openings 111 and 112 as shown in FIG. 4.

The second case 200 has first and second rear protrusions 231 and 232, opposite to each other, on the rear. The first and second rear protrusions 231 and 232 protrude downward from the rear side of the second case 200. The first rear protrusion 231 forms the rear section of the first longitudinal pocket 131 as shown in FIG. 9. The second rear protrusion 232 forms the rear section of the second longitudinal pocket 132 as shown in FIG. 9. When the first and second cases 100 and 200 are combined into a single body, the first front protrusions 151 and the first rear protrusion 231, and the second front protrusions 152 and the second rear protrusion 232 form the first and second longitudinal pockets 131 and 132 as shown in FIG. 9, respectively As shown in FIGS. 4 through 7, the first and second cases 100 and 200 connect to each other by inserting the first and second protrusions 121 and 122 into the first and second indentations 221 and 222, respectively. At this point, the first and second connection protrusions 211 and 212 are inserted into the first and second openings 111 and 112, respectively. This prevents the second case 200 from rotating on its own axis.

Figure 8:
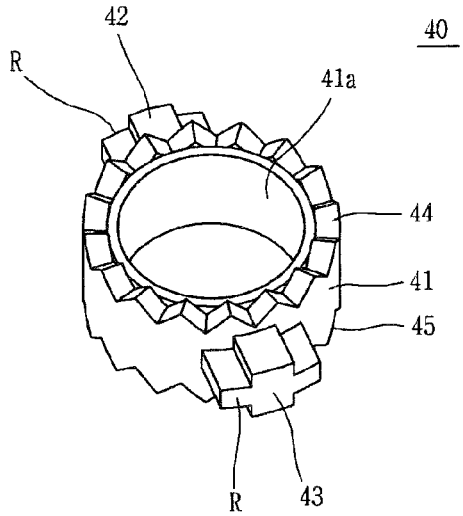
FIG. 8 is a perspective view of the holder of FIG. 3.

FIG. 8 is a perspective view of the holder of FIG. 3. FIG. 9 is a view illustrating that the holder of FIG. 3 moves and rotates within the case.

As shown in FIG. 8, the holder 40 includes a holder body 41, a first spindle 42, a second spindle 43, and a sliding-prevention part. The holder body 41 is circular. The holder body has a hole 41A in the middle. The magnet 50, as shown in FIG. 3, fits into the hole 41A. So, the magnet is held firmly in place in the hole 41A. If not, the magnet may be held firmly in place in the hole 41A with an adhesive agent. The holder 40 may be made of plastic by plastic molding, in a manner that encircles an edge of the magnet 50. The first and second spindles 42 and 43, opposite to each other, are provided on the outside circumferential surface of the holder body 41.

As shown in FIG. 9, the holder 40 is movably and rotatably installed within the case 30. A dotted-line arrow indicates the direction in which the holder 40 moves and rotates within the case 30.

The holder 40 moves within the case 30, with the respective ends of the first and second spindles 42 and 43 being supported by the first and second longitudinal pockets 131 and 132. That is, the first and second longitudinal pockets 131 and 132 guide motions of the first and second spindles 41 and 42. The holder 40 can move backward farther until the first and second spindles 42 and 43 are blocked by the first and second rear protrusions 231 and 232, respectively, and move forward farther until the first and second spindles 42 and 43 arrive at the bottoms of the first and second spindle pockets 141 and 142, respectively.

The holder 40 rotates about the center line Z within the case 30, with the respective ends of the first and second spindles 42 and 43 being inserted into the first and second longitudinal pockets 131 and 132. As shown in FIG. 8, the ends of the first and second spindles 42 and 43 are rounded, thereby facilitating rotation of the holder 40.

Figure 10:
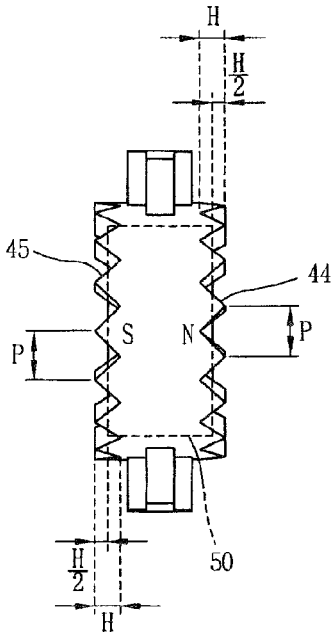
FIG. 10 is a view illustrating that the magnet of FIG. 3 is installed within the holder of FIG. 3.
Figure 11:
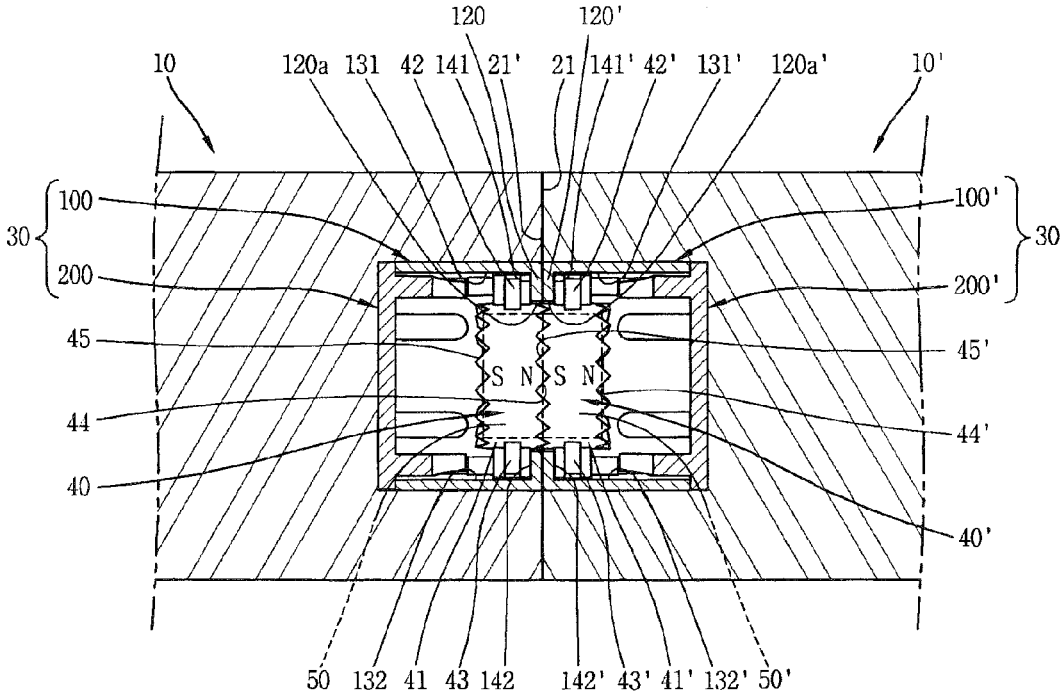
FIG. 11 is a view illustrating that a contact surface of a first block comes in contact with a contact surface of a second block.

FIG. 10 is a view illustrating that the magnet of FIG. 3 is installed within the holder of FIG. 3. FIG. 11 is a view illustrating that a contact surface of a first block comes in contact with a contact surface of a second block.

As shown in FIG. 10, the sliding-prevention part includes first alternate teeth 44 and second alternate teeth 45. The first alternate teeth 44 are provided on the front of the holder body 41. The second alternate teeth 45 are provided on the rear of the holder body 41.

The first alternate teeth 44 and the second alternate teeth 45 are the same in pitch and depth H. The first alternate teeth 44 and the second alternate teeth 45 are phase-shifted relative to each other by 180 degrees. The thickness of the magnet 50 is such that one pole face of the magnet 50 is positioned at half of depth of the first alternate teeth 44 and the other pole face of the magnet 50 is positioned at half of depth of the second alternate teeth 45.

As a result, as shown in FIG. 11, the first alternate teeth 44 in the first block 10 and the second alternate teeth 45' in the second block 10' mesh properly when the first and second blocks 10 and 10' connect to each other. The contact surface 21 of the first block 10 and the contact surface 21' of the second block 10' come in contact with each other, as well as the magnets 50 and 50' of the first and second blocks 10 and 10'. This prevents the first and second blocks 10 and 10' from sliding off with respect to each other.

The magnet 50 is circular and has south and north pole faces. The circular magnet with south and north faces is commonplace and, therefore, is cost-effective, compared with the magnet with two or more poles on one face.

Figure 12:
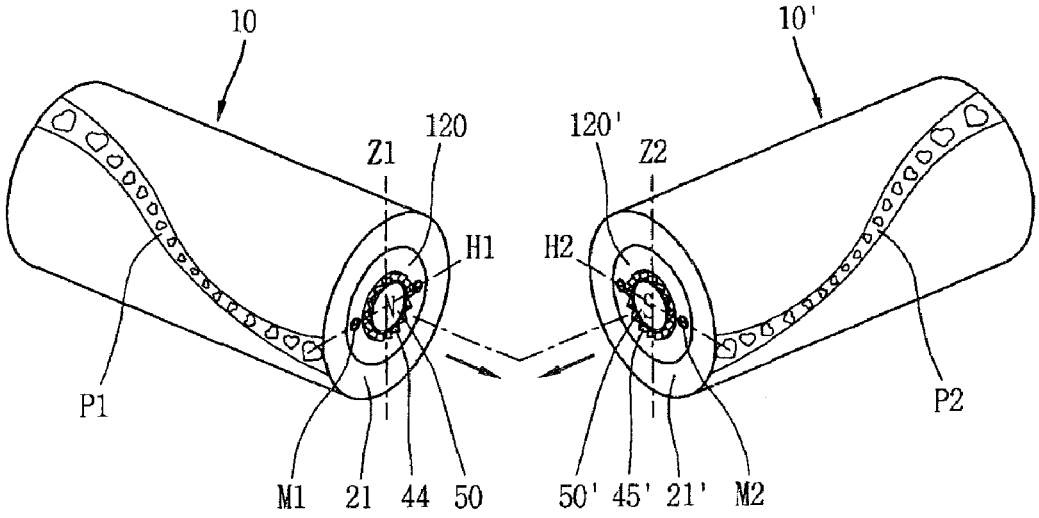
FIG. 12 is a view illustrating that the blocks has their respective paintings on the body.

FIG. 12 is a view illustrating that the blocks 10 and 10' has their respective paintings on the body. When the blocks 10 and 10' connect to each other, the two paintings connect to each other to become a bigger one.

As shown in FIG. 12, the first and second blocks 10 and 10' have the paintings P1 and P2.

The two reference points M1 are marked on the front of the case cover 120 in the first block. The two reference points M1 is on the line passing the center point of the case cover 120. A line H1 connecting between the two reference points M1 is perpendicular to a center line Z1 about which the holder 40, as shown in FIG. 11, rotates.

The two reference points M2 are marked on the front of the case cover 120' in the second block. The two reference points M2 is on the line passing the center point of the case cover 120'. A line H2 connecting between the two reference points M2 is perpendicular to a center line Z2 about which the holder 40', as shown in FIG. 11, rotates.

When the reference points M1 and M2 overlap with each other, the paintings P1 and P2 exactly connect to each other, as well as unlike pole faces of the magnets 50 and 50' in the first and second blocks 10 and 10'. At this point, the first alternate teeth 44 in the first block 10 and the second alternate teeth 45' in the second block 10' mesh properly, and the contact surface 21 of the first block 10 and the contact surface 21' of the second block 10' come in contact with each other.

The order in which the first and second blocks 10 and 10' connect to each other is now described.

Figure 13A:
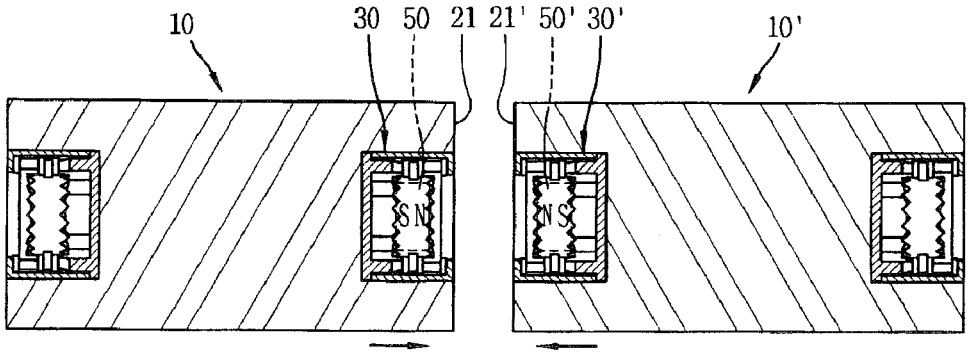
FIGS. 13A, 13B, and 13C are views illustrating the order in which the first and second blocks connect to each other.
Figure 13B:
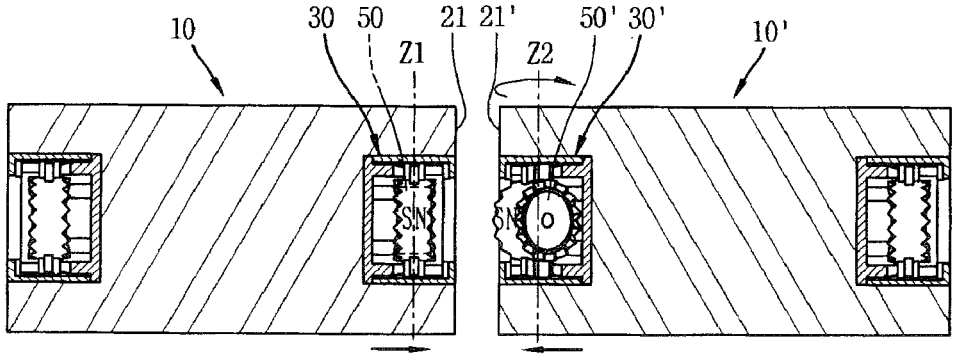
Figure 13C:
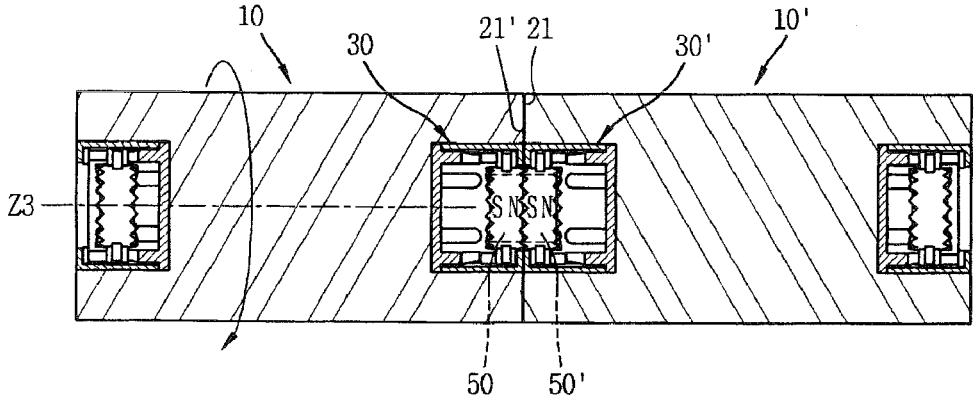

FIGS. 13A, 13B, and 13C are views illustrating the order in which the first and second blocks 10 and 10' connect to each other.

As shown in FIG. 13A, the first and second blocks 10 and 10' move towards each other for connection. Assume that an outside face of the magnet 50 in the first block 10 has a north pole and an outside face of the magnet 50' in the second block 10' has a north pole.

As shown in FIG. 13B, the magnet 50' in the second block 10' rotates about the center line Z2, because like pole faces repel each other. So, the outside face of the magnet 50' has a south pole. Otherwise, the magnet 50 in the first block 10 rotates about the center line Z1. So, the outside face of the magnet 50 has a south pole. In this manner, the outside faces of the magnets 50 and 50' have unlike poles. The magnets 50 and 50' attract each other, thereby connecting the blocks 10 and 10'.

Assume that the outside faces of the magnets 50 and 50' have unlike poles. Then, any of the magnets 50 and 50' doesn't need to rotate. The magnets 50 and 50' attract each other as they are, thereby connecting the blocks 10 and 10'.

As shown in FIGS. 11 and 13C, when the first and second blocks 10 and 10' connect to each other, the holder body 41 of the holder 40 is inserted into the hole 120A in the case cover 120 on the first case 100 in the first block 10 and at the same time the first and second spindle 42 and 43 are inserted into the first and second spindle pockets 141 and 142, respectively And the holder body 41' of the holder 40' is inserted into the hole 120A' in the case cover 120' on the first case 100' in the second block 10' and at the same time the first and second spindle 42' and 43' are inserted into the first and second spindle pockets 141' and 142', respectively.

The magnets 50 and 50' of the first and second blocks 10 and 10' connect to each other. Accordingly, the first alternate teeth 44 in the first block 10 and the second alternate teeth 45' in the second block 10' mesh properly. The holder 40 cannot rotate itself because the first and second spindles 42 and 43 fit into the first and second spindle pockets 141 and 142, respectively, and therefore are held unmovable. The holder 40' cannot rotate itself because the first and second spindles 42' and 43' fit into the first and second spindle pockets 141' and 142', respectively, and therefore are held unmovable.

The first and second blocks 10 and 10' can rotate about Z3 in opposite directions while they remain in contact with each other for connection. As shown in FIG. 13C, for example, when the first block 10 rotates about Z3 in the direction in which the solid-line arrow indicates, the first alternate teeth 44 in the first block 10 can go over the second alternate teeth 45' in the second block 10' while the first alternate teeth 44 and the second alternate teeth 45' mesh properly. At this point, a frictional sound is produced between the first alternate teeth 44 and the second alternate teeth 45'.

As the present disclosure may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. A block for building a toy, comprising:

a body;

a case installed in the body;

a holder with a sliding-prevention part, movably and rotatably provided within the case; and a magnet with south and north pole faces, installed in the holder, wherein the holder comprises:

a holder body; and first and second spindles, opposite to each other, provided on an outside circumferential surface of the holder body, wherein the sliding-prevention part comprises:

first alternate teeth provided on a top front of the holder body; and second alternate teeth provided on a rear of the holder body, wherein the first and second alternate teeth are the same in pitch and depth and are phase-shifted relative to each other by 180 degrees.

2. The block for building a toy according to claim 1, wherein the body is made of wood.

3. The block for building a toy according to claim 1, wherein the holder body has a hole in a middle thereof, into which the magnet fits, and wherein ends of the first and second spindles are rounded.

4. The block for building a toy according to claim 3, wherein the case comprises:

a first case comprising a case body and a case cover that covers a front of the case body; and a second case connected to the first case.

5. The block for building a toy according to claim 4, wherein two reference points are marked on a front of the case cover, and wherein a line passing a center point of the case cover and connecting the two reference points extends perpendicular to a center line about which the holder rotates.

6. The block for building a toy according to claim 4, wherein the case cover has a hole in a middle thereof, wherein the case body has first and second openings and first and second protrusions on ends thereof, and wherein the second case has first and second indentations on a front thereof, into which the first and second protrusions are inserted, respectively, and first and second connection protrusions on an outside circumferential surface thereof, which are inserted into the first and second openings, respectively.

7. The block for building a toy according to claim 4, wherein first and second spindle pockets, opposite to each other, into which the first and second spindles are inserted, respectively, are provided on a rear of the case cover, wherein first and second front protrusions, which form front sections of first and second longitudinal pockets, respectively, protrude from the rear of the case cover and a lateral side of the case body, behind the first and second spindle pockets, with the first and second spindle pockets in between, respectively, and wherein first and second rear protrusions, opposite to each other, are provided on a rear of the second case, and protrude downward from the rear of the second case, the first and second rear protrusions forming rear sections of the first and second longitudinal pockets.

8. The block for building a toy according to claim 1, wherein a thickness of the magnet is such that one pole face of the magnet is positioned at half of a depth of the first alternate teeth and the other pole face of the magnet is positioned at half of a depth of the second alternate teeth.

9. A block for building a toy, comprising:

a body;

at least one case installed in the body;

at least one holder with a sliding-prevention part, movably and rotatably provided within the at least one case; and at least one magnet with south and north pole faces, installed in the at least one holder, wherein the at least one holder comprises:

a holder body; and first and second spindles, opposite to each other, provided on an outer circumferential surface of the holder body, wherein the sliding-prevention part comprises:

a first plurality of teeth provided on a first end of the holder body; and a second plurality of teeth provided on a second end of the holder body, wherein the first and second plurality of teeth are the same in pitch and depth and are phase-shifted relative to each other by 180 degrees.

10. The block for building a toy according to claim 9, wherein the body is made of wood.

11. The block for building a toy according to claim 9, wherein the holder body has a hole in a middle thereof configured to receive the at least one magnet, and wherein ends of the first and second spindles are rounded.

12. The block for building a toy according to claim 11, wherein the at least one case comprises:

a first case comprising a case body and a case cover that covers a front of the case body; and a second case connected to the first case.

13. The block for building a toy according to claim 12, wherein two reference points are marked on a front of the case cover, and wherein a line passing a center point of the case cover and connecting the two reference points extends perpendicular to a center line about which the holder rotates.

14. The block for building a toy according to claim 13, wherein the case cover has a hole in a middle thereof, wherein the case body has first and second openings and first and second protrusions on ends thereof, and wherein the second case has first and second indentations on an end thereof, into which the first and second protrusions are inserted, respectively, and first and second connection protrusions on an outside circumferential surface thereof, which are inserted into the first and second openings, respectively.

15. The block for building a toy according to claim 13, wherein first and second spindle pockets, opposite to each other, into which the first and second spindles are inserted, respectively, are provided on the case cover, wherein first and second protrusions of first and second longitudinal pockets, respectively, protrude from the case cover and a side of the case body, behind the first and second spindle pockets, with the first and second spindle pockets in between, respectively, and wherein third and fourth protrusions, opposite to each other, are provided on the second case, and protrude downward from the second case, the third and fourth protrusions forming sections of the first and second longitudinal pockets.

16. The block for building a toy according to claim 9, wherein a thickness of the at least one magnet is such that one pole face of the at least one magnet is positioned at half of a depth of the first plurality of teeth and the other pole face of the at least one magnet is positioned at half of a depth of the second plurality of teeth.

* * * * *